US011808124B1

(12) United States Patent
Shetty

(10) Patent No.: US 11,808,124 B1
(45) Date of Patent: Nov. 7, 2023

(54) AUTOMATED BALL-SEAT EVENT DETECTION

(71) Applicant: Halliburton Energy Services, Inc., Houston, TX (US)

(72) Inventor: Dinesh Ananda Shetty, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/851,263

(22) Filed: Jun. 28, 2022

(51) Int. Cl.

| | |
|---|---|
| ***E21B 34/14*** | (2006.01) |
| ***E21B 43/26*** | (2006.01) |
| ***E21B 21/08*** | (2006.01) |
| *E21B 43/14* | (2006.01) |

(52) U.S. Cl.
CPC ..... *E21B 43/26* (2013.01); *E21B 21/08* (2013.01); *E21B 43/14* (2013.01)

(58) Field of Classification Search
CPC .. E21B 43/26; E21B 2200/20; E21B 2200/06; E21B 34/142
See application file for complete search history.

(56) References Cited

U.S. PATENT DOCUMENTS

| | | | | |
|---|---|---|---|---|
| 9,611,727 | B2 * | 4/2017 | Campbell | E21B 43/26 |
| 10,422,220 | B2 * | 9/2019 | Enkababian | E21B 41/0092 |
| 11,156,071 | B2 * | 10/2021 | Chang | E21B 34/14 |
| 11,566,504 | B2 * | 1/2023 | Perez | E21B 43/26 |
| 2011/0284232 | A1 * | 11/2011 | Huang | E21B 34/14 977/775 |
| 2012/0234534 | A1 | 9/2012 | Hughes et al. | |
| 2013/0213646 | A1 * | 8/2013 | Angman | E21B 43/14 166/184 |
| 2019/0242224 | A1 * | 8/2019 | Keller | E21B 43/26 |

OTHER PUBLICATIONS

Shen, et al.; "Near Real-Time Hydraulic Fracturing Event Recognition Using Deep Learning Methods"; Society of Petroleum Engineers; SPE199738-PA; SPE Hydraulic Fracturing Technology Conference and Exhibition; Feb. 4-6, 2020; 12 pgs.

Shen, et al.; "Development of a Ball Seat Event Recognition Algorithm with Convolutional Neural Network for the Real-Time Hydraulic Fracturing Analytics System"; Society of Petroleum Engineers; SPE-200003-MS; SPE Canada Unconventional Resources Conference, Mar. 18-19, 2020, 7 pgs.

* cited by examiner

*Primary Examiner* — Kenneth L Thompson
(74) *Attorney, Agent, or Firm* — Michael Jenney; Parker Justiss, P.C.

(57) ABSTRACT

This disclosure presents processes for automatically detecting a ball-seat event in a wellbore. The processes can automatically detect a ball-seat event and automatically fracture a formation at a next treatment zone once the ball-seat event has been automatically detected. The processes for automatically detecting the ball-seat event can determine a volume ratio is in a predetermined range and within a minimum and maximum bound, then determine a slurry rate is in a predetermined range and is within a minimum and maximum bound, then determine a slope of a slurry rate is in a predetermined range and within a minimum and maximum bound, and then determine a slope of a pressure change of the fracturing fluid in the wellbore is in a predetermined range and within a minimum and maximum bound.

20 Claims, 10 Drawing Sheets

200

300

400

500

600

700

800

AUTOMATED BALL-SEAT EVENT DETECTION

TECHNICAL FIELD OF THE DISCLOSURE

The disclosure relates generally to controlling a hydraulic fracturing treatment and, particularly, to techniques to automatically detect a ball-seat event.

BACKGROUND

In the oil and gas industry, a well that is not producing as expected may need stimulation to increase production of subsurface hydrocarbon deposits, such as oil and natural gas. Hydraulic fracturing is a type of stimulation treatment that has long been used for well stimulation in unconventional reservoirs. A stimulation treatment operation may involve drilling a horizontal wellbore and injecting treatment fluid into a surrounding formation in multiple stages via a series of perforations or entry points along a path of a wellbore through the formation. During each stimulation treatment, different types of fracturing fluids, proppant materials (e.g., sand), additives, and/or other materials may be pumped into the formation via the entry points or perforations at high pressures and/or rates to initiate and propagate fractures within the formation to a desired extent.

SUMMARY OF THE DISCLOSURE

In one aspect, a method of controlling automated fracturing operations in a wellbore is disclosed. In one embodiment, the method includes automatically detecting a ball-seat event and automatically fracturing a formation at a next treatment zone once the ball-seat event has been automatically detected. In one embodiment, the automatically detecting includes (1) determining a volume ratio is in a predetermined range and within a minimum and maximum bound, wherein the volume ratio is a ratio of a volume of a fracturing fluid pumped into the wellbore from a time a ball is introduced into the wellbore to a predetermined volume of the wellbore, (2) then determining a slurry rate is in a predetermined range and is within a minimum and maximum bound, (3) then determining a slope of a slurry rate is in a predetermined range and within a minimum and maximum bound, and (4) then determining a slope of a pressure change of the fracturing fluid in the wellbore is in a predetermined range and within a minimum and maximum bound.

In a second aspect, a computer program product having a series of operating instructions stored on a non-transitory computer-readable medium that cause at least one processor to perform operations is disclosed. In one embodiment, the operations include automatically detecting a ball-seat event and automatically fracturing a formation at a next treatment zone once the ball-seat event has been automatically detected. In one embodiment, the automatically detecting includes (1) determining a volume ratio is in a predetermined range and within a minimum and maximum bound, wherein the volume ratio is a ratio of a volume of a fracturing fluid pumped into a wellbore from a time a ball is introduced into the wellbore to a predetermined volume of the wellbore, (2) then determining a slurry rate is in a predetermined range and is within a minimum and maximum bound, (3) then determining a slope of a slurry rate is in a predetermined range and within a minimum and maximum bound, and (4) then determining a slope of a pressure change of the fracturing fluid in the wellbore is in a predetermined range and within a minimum and maximum bound.

In a third aspect, a computing system to control automated fracturing operations in a wellbore is disclosed. In one embodiment, the computing system includes one or more processors. In one embodiment the one or more processors perform one or more operations including automatically detecting a ball-seat event and automatically fracturing a formation at a next treatment zone once the ball-seat event has been automatically detected. In one embodiment, the automatically detecting includes (1) determining a volume ratio is in a predetermined range and within a minimum and maximum bound, wherein the volume ratio is a ratio of a volume of a fracturing fluid pumped into the wellbore from a time a ball is introduced into the wellbore to a predetermined volume of the wellbore, (2) then determining a slurry rate is in a predetermined range and is within a minimum and maximum bound, (3) then determining a slope of a slurry rate is in a predetermined range and within a minimum and maximum bound, and (4) then determining a slope of a pressure change of the fracturing fluid in the wellbore is in a predetermined range and within a minimum and maximum bound.

BRIEF DESCRIPTION OF THE DRAWINGS

Reference is now made to the following descriptions taken in conjunction with the accompanying drawings, in which.

DETAILED DESCRIPTION

In well stimulation, the ability to perforate multiple zones in a single well and then fracture each zone independently, referred to as "zone fracturing," has increased access to potential reserves. Many wells are drilled with zone fracturing planned at the well's inception. Zone fracturing helps stimulate the well by creating conduits in a formation for hydrocarbons to reach the well. A well drilled with planned fracturing zones will be equipped with a string of piping below a cemented casing portion of the well. The string is segmented with packing elements and perforation plugs containing ball seats to isolate zones. A ball is dropped or pumped down the well and seats in its intended perforation plug, thereby isolating pressure from above. Typically, a ball seat has an axial opening of a select diameter. To the extent multiple perforation plugs are disposed along a string, the diameter of these seats in respective perforation plugs becomes progressively smaller with the depth of the string. This permits a plurality of balls having a progressively increasing diameter to be dropped (or pumped), smallest to largest diameter, down the well to isolate various zones, starting from a toe of the well and moving up. When the well stimulation in a particular zone is complete, pressure from within the formation should return the ball utilized in a particular zone to the surface, carrying the ball upward in the flow of return fluids.

For automated fracturing operations, it is imperative to detect when the ball has seated in the ball seat of a corresponding perforation plug so that the automated fracturing process can increase a flow rate of fracturing fluid (including and other materials, e.g., proppants, stop-loss materials) to proceed with a fracturing treatment for a next fracturing zone. At present, detecting a ball-seat event is required to be performed using human monitoring before continuing the fracture treatment in the next fracturing zone. If the fracturing fluid rate is increased before the ball is seated in its intended perforation plug, the increased fracturing fluid rate can move the ball at a high rate of force which can damage the perforation plug and can lead to leakages resulting in loss of fracturing efficiency. However, if the ball-seat detection is delayed, the fracturing treatment time will increase and an amount of materials used will also increase.

Figure 1:
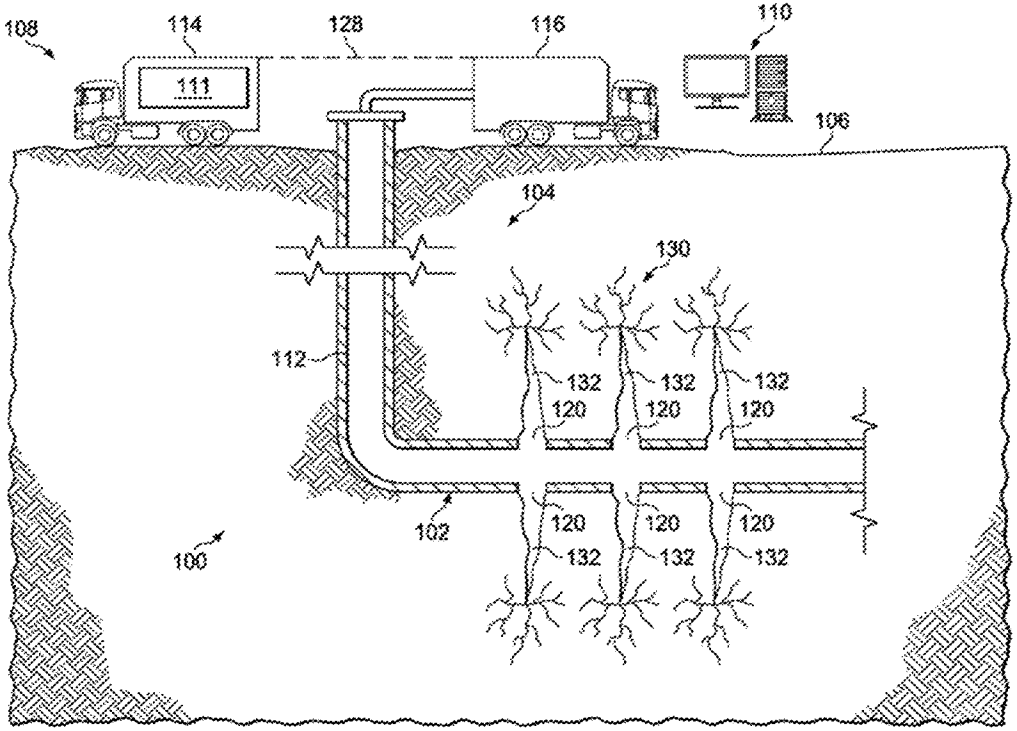
FIG. 1 illustrates a hydraulic fracturing operation.

FIG. 1 shows an environment 100 of an illustrative hydraulic fracturing operation together with a symbolic computing subsystem 110. A wellbore 102 extends into a subterranean region 104 beneath the ground surface 106. Typically, the subterranean region 104 includes a reservoir that contains hydrocarbon resources such as oil or natural gas. For example, the subterranean region 104 may include all or part of a rock formation (e.g., shale, coal, sandstone, granite, or others) that contains natural gas. The subterranean region 104 may include naturally fractured rock or natural rock formations that are not fractured to any significant degree. When the subterranean region 104 includes tight gas formations (i.e., natural gas trapped in low permeability rock such as shale), it is typically desirable to increase the degree of fracturing in the formation to increase the formation's effective permeability.

Accordingly, FIG. 1 also shows an injection assembly 108 coupled to a conduit 112 in wellbore 102. The injection assembly 108 includes one or more instrument trucks 114, represented by a single instrument truck in FIG. 1, and one or more pump trucks 116, represented by a single pump truck in FIG. 1, that operate to inject fluid via the conduit 112 into the subterranean region 104, thereby opening existing fractures and creating new fractures. The fluid reaches the formation via one or more fluid injection locations 120, which in many cases are perforations in the conduit 112. The conduit 112 may include casing cemented to the wall of the wellbore 102, though this is not a requirement. In some implementations, all or a portion of the wellbore 102 may be left open, without casing. The conduit 112 may include a working string, coiled tubing, sectioned pipe, or other types of conduit.

The fracture treatment may employ a single injection of fluid to one or more fluid injection locations, or it may employ multiple such injections, optionally with different fluids. Where multiple fluid injection locations are employed, they can be stimulated concurrently or in stages. Moreover, they need not be located within the same wellbore, but may for example be distributed across multiple wells or multiple laterals within a well. An injection treatment control subsystem 111 coordinates operation of the injection assembly components to monitor and control the fracture treatment. It may rely on computing subsystem 110, which represents various data acquisition and processing subsystems optionally distributed throughout the injection assembly 108 and wellbore 102, as well as any remotely coupled offsite computing facilities available to the injection treatment control subsystem 111.

The pump trucks 116 can include mobile vehicles, immobile installations, skids, hoses, tubes, fluid tanks, fluid reservoirs, pumps, valves, mixers, or other types of structures and equipment. The pump trucks 116 can supply treatment fluid and other materials (e.g., proppants, stop-loss materials) for the injection treatment. The illustrated pump trucks 116 communicate treatment fluids into the wellbore 102 at or near the level of the ground surface 106. The pump trucks 116 are coupled to valves and pump controls for starting, monitoring, stopping, increasing, decreasing or otherwise controlling pumping as well as controls for selecting or otherwise controlling fluids pumped during the injection treatment.

The instrument trucks 114 can include mobile vehicles, immobile installations, or other suitable structures and sensors for measuring temperatures, pressures, flow rates, and other treatment and production parameters. The example instrument trucks 114 shown in FIG. 1 include injection treatment control subsystem 111 that controls or monitors the injection treatment applied by the injection assembly 108. The injection assembly 108 may inject fluid into the formation above, at, or below a fracture initiation pressure; above, at, or below a fracture closure pressure; or at another fluid pressure.

Communication links 128 enable the instrument trucks 114 to communicate with the pump trucks 116, and other equipment at the ground surface 106. Additional communication links enable the instrument trucks 114 to communicate with sensors or data collection apparatus in the wellbore 102, other wellbores, remote facilities, and other devices and equipment. The communication links can include wired or wireless communications assemblies, or a combination thereof.

The injection treatment control subsystem 111 may include data processing equipment, communication equipment, or other assemblies that control injection treatments applied to the subterranean region 104 through the wellbore 102. The injection treatment control subsystem 111 may be communicably linked to the computing subsystem 110 that can calculate, select, or optimize treatment parameters for initiating, opening, and propagating fractures in the subterranean region 104. The injection treatment control subsystem 111 may receive, generate, or modify an injection treatment plan (e.g., a pumping schedule) that specifies properties of an injection treatment to be applied to the subterranean region 104. Injection treatment control subsystem 111 shown in FIG. 1 controls operation of the injection assembly 108.

FIG. 1 shows that an injection treatment has fractured the subterranean region 104. FIG. 1 shows examples of dominant fractures 132 extending into natural fracture networks 130, the dominant fractures having been formed and opened by fluid injection through perforations 120 along the wellbore 102. Generally, induced fractures may extend through naturally fractured rock, regions of un-fractured rock, or both. The injected fracturing fluid can flow from the dominant fractures 132, into the rock matrix, into the natural fracture networks 130, or in other locations in the subterranean region 104. The injected fracturing fluid can, in some instances, dilate or propagate the natural fractures or other pre-existing fractures in the rock formation. It should be noted that the induced hydraulic fractures can interact with each other and with the existing natural fractures, thus generating a complex fracture network structure. As illustrated in FIG. 1, wellbore 102 may include a horizontal wellbore. However, the fracturing operations of FIG. 1 may include any combination of horizontal, vertical, slant, curved, or other wellbore orientations. Additionally, wellbore 102 may be disposed or positioned in a subsea environment.

Real-time observations may be obtained from pressure meters, flow monitors, microseismic equipment, tiltmeters, or such equipment. For example, pump truck 116 may include pressure sensors and flow monitors to monitor a pressure and flow rate of the hydraulic fracturing fluid at the surface 106 during a stimulation operation.

Some of the techniques and operations described herein may be implemented by a one or more computing assemblies configured to provide the functionality described. In various instances, a computing assembly may include any of various types of devices, including, but not limited to, handheld mobile devices, tablets, notebooks, laptops, desktop computers, workstations, mainframes, distributed computing networks, and virtual (cloud) computing systems. In addition to the functions described above, the computing subsystem 110, the injection treatment control subsystem 111, or a combination of both can be configured to perform or direct operation of the illustrative systems and methods described herein. For example, the system for detection of ball-seat events 900, such illustrated in FIG. 9, or the method for detection of ball-seat events 800 of FIGS. 8A-8B can be implemented at least in part by the computing subsystem 110, the injection treatment control subsystem 111, or a combination thereof.

Figure 2:
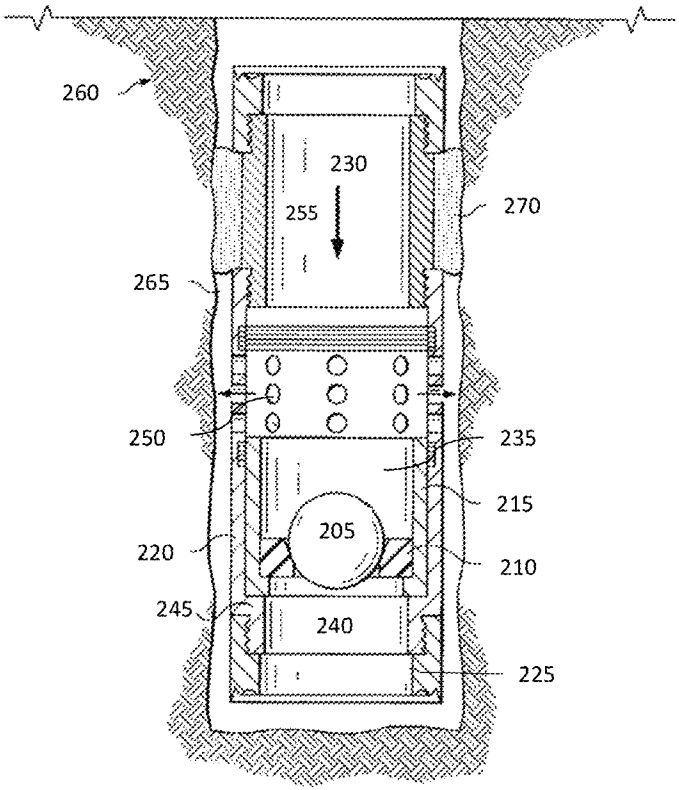
FIG. 2 illustrates a perforation plug with a ball seated therein.

FIG. 2 illustrates an example of a perforation plug 200 for a fracturing zone, e.g., such as that disclosed above, with a fracturing ball 205 seated on a perforation plug seat 210 which is sealably housed in a sleeve 215 carried in a tube 220 of a pipe string 225. Sleeve 215 is slidable between a second position shown in FIG. 2 and a first position before the ball 205 has been seated. Those of ordinary skill in the art will appreciate that as fluid, such as fracturing fluid, is pumped down the well as shown by directional arrow 230, a pressure differential between upstream fluid 235 and downstream formation fluids 240, as applied across ball 205 and seat 210, urges sleeve 215 into the second position. In this second position, sleeve 215 abuts shoulder 245 of tube 220. Tube 220 is provided with a plurality of radial apertures or holes 250 that serve as a conduit from interior 255 of tube 220 to formation 260, thereby permitting the fracturing fluid pumped from a surface to infiltrate annulus 265 between pipe string 225 and formation 260. Moreover, when sleeve 215 is in the second position, apertures 250 are fully open to permit fluid flow therethrough. Packing element 270 is one of many packing elements that partition annulus 265 into different fracturing zones. A second packing element (not shown) is disposed downstream of perforations 250 so that the packing elements straddle the fracturing zone and seal the fracturing zone from a remainder of annulus 265.

Figure 3:
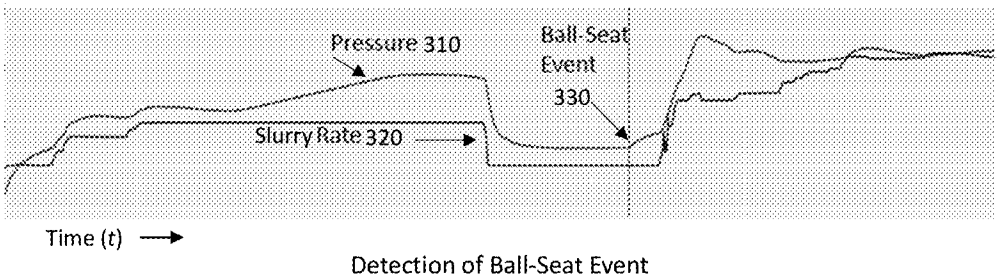
FIG. 3 illustrates an example of data collected to determine a ball-seat event.
Figure 4:
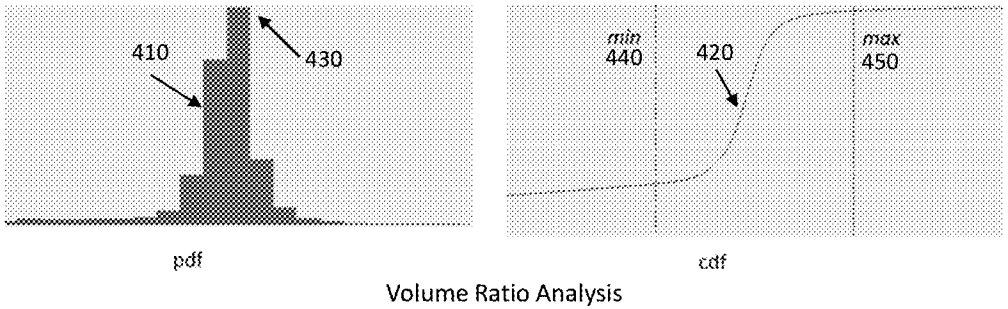
FIG. 4 illustrates an example of a volume ratio analysis.

FIG. 3 is a graph 300 of an example of data collected over time (x-axis), e.g., fracturing fluid pressure 310 and a rate of slurry (typically a mixture of water, chemicals, and proppant, etc.) 320 provided to a wellbore (slurry rate), to determine a ball-seat event 330, i.e., when a ball is dropped and pumped into a wellbore and is seated in a perforation plug, the ball seals off an earlier fracturing zone in order to create a new fracturing zone. It is known to those skilled in the art that a plurality of balls of a same diameter pumped into a wellbore along with a fracturing fluid can seat in plurality of same diameter ball seats in a specific perforation plug rather than a single ball as described above and below. As noted above, this determination of a ball-seat event is a manual process where human interpretation of pressure readings is used for ball-seat event detection. As shown in FIG. 3, a human would interpret that a ball-seat event 330 occurs when both the fracturing fluid pressure, e.g., as shown by pressure trace 310, and a slurry rate, e.g., as shown by slurry rate trace 320 drop for a predetermine set period of time. However, historical data, such as, e.g., fracturing fluid pressure, slurry rate, and amount of fluid pumped, etc. can be used by an algorithm to automatically determine the ball-seat event rather than through manual human interpretation. The illustrative systems and methods described herein automatically determine the ball-seat event by comparing real-time data, e.g., fracturing fluid pressure, slurry rate, and volume of fluid pumped, etc., to historical data using the algorithm as described below. Furthermore, the real-time data can be easily collected at or about a surface of the wellbore rather than being collected from downhole where collection of data downhole is typically more complex and expensive than collection of data at or about a surface of the wellbore A first step in the algorithm is to analyze a volume of fluid used to pump at least one fracturing ball into a wellbore. FIG. 4 illustrates graphs 400 of both a probability distribution 410 and cumulative probability distribution 420 of historical data of a ratio of a volume of fluid pumped into a wellbore (along with at least one fracturing ball when a ball is released into the wellbore) to seat the at least one ball in a perforation plug to an actual volume of the wellbore from a surface to the perforation plug, i.e., a volume ratio analysis. In FIG. 4, the x-axis in both the probability 410 and cumulative probability 420 distributions represents, e.g., a volume ratio as disclosed above. In the absence of gravity and leakage, one wellbore volume (e.g., the volume of a wellbore from a surface to a perforation plug) of fluid would be required to move the ball from the surface to the perforation plug. However, gravity can cause the ball to either travel faster than the fluid traveling in a vertical part of the wellbore or to travel slower than the fluid traveling in a horizontal part of the wellbore. Further, the fracturing fluid can also leak around the ball while the ball is traveling in the wellbore and enter an earlier fracturing zone. Thus, these effects can cause a volume of fracturing fluid needed to actually seat a ball in a perforation plug to fluctuate.

An analysis of a ratio of historical data for a volume of fluid pumped into a wellbore until the ball seats to an actual volume of the wellbore, i.e., a volume ratio, is shown in FIG. 4. From this historical volume ratio, a most likely volume ratio 430 for when a ball-seat event occurs can be determined (e.g., from the probability distribution 410 of FIG. 4) and rules that bound (i.e., a minimum 440 and maximum 450 value of the volume ratio as shown in the cumulative probability distribution 420 of FIG. 4) when a ball-seat event can occur can also be determined. Thus, the first step in the algorithm is to compare a real-time volume ratio to historical volume ratios to determine if the real-time volume ratio occurs at the historical most likely volume ratio and/or also determine if the real-time volume ratio is within the historical bounds (i.e., minimum and maximum) for the volume ratio when the ball-seat event occurs.

Figure 5:
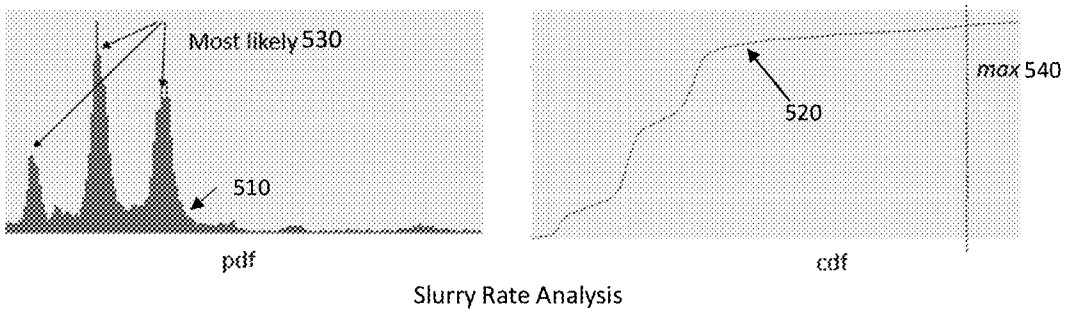
FIG. 5 illustrates an example of a slurry rate analysis.

If it is determined that the real-time volume ratio falls within the historical bounds, the algorithm proceeds to a next step where a slurry rate is analyzed by the algorithm. FIG. 5 illustrates graphs 500 of both a probability distribution 510 and cumulative probability distribution 520 of historical slurry rates of fluid (e.g., slurry) pumped into a wellbore when a ball is released into the wellbore, i.e., a slurry rate analysis. In FIG. 5, the x-axis in both the probability 510 and cumulative probability 520 distributions represents, e.g., a slurry rate as disclosed above. In general, a ball-seat event occurs at a lower slurry rate to avoid potential damage to the perforation plug due to momentum of the ball.

An analysis of the historical slurry rates until a ball seats is shown in FIG. 5. From historical slurry rates (both the probability distribution 510 and the cumulative probability distribution 520), most likely rates 530 at which a ball-seat occurs can be obtained, e.g., as noted in the probability distribution 510 of FIG. 5. Further, a bound of the slurry rate below which a ball-seat event occurs can also be determined from historical slurry rates (noted as the maximum line 540 in the cumulative probability distribution 520 of FIG. 5). Thus, the second step in the algorithm is to compare a real-time slurry rate to historical slurry rates to determine if the real-time slurry rate occurs at the historical most likely slurry rates for a ball-seat event and/or also determine if the real-time slurry rate is below the historical bound at which a ball-seat event occurs.

Figure 6:
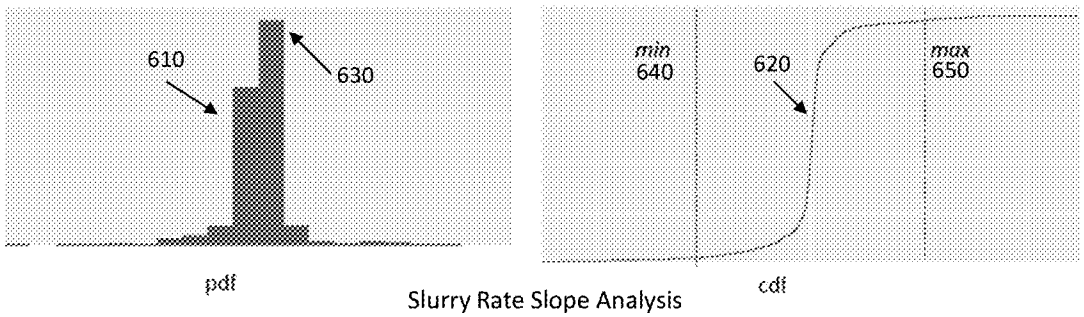
FIG. 6 illustrates an example of a slurry rate analysis.

If it is determined that the real-time slurry rate occurs at the historical most likely slurry rate (and if the real-time slurry rate is below the historical bound at which a ball-seat event occurs), the algorithm proceeds to a next step where rate of change of the slurry rate or slope of the slurry rate is analyzed by the algorithm, i.e., a slurry rate slope analysis. FIG. 6 illustrates graphs 600 of both a probability distribution 610 and a cumulative probability distribution 620 of historical slopes of a slurry rates pumped into a wellbore when a ball is released into the wellbore. In FIG. 6, the x-axis in both the probability 610 and cumulative probability 620 distributions represents, e.g., a slope of a slurry rate as disclosed above. In general, if the slope of slurry rate is held at or close to a constant, the determination of the ball-seat event from the first steps of the algorithm is more accurate. Thus, the slope of the slurry rate can be utilized to detect a ball-seat event window.

An analysis of historical slopes of slurry rates until a ball seats is shown in FIG. 6. From the historical slopes of slurry rates (both the probability distribution 610 and the cumulative probability distribution 620), a most likely slope of slurry rate 630 at which a ball-seat occurs can be determined (e.g., from the probability distribution 610 of FIG. 6) and rules that bound (i.e., a minimum 640 and maximum 650 value of this slope of slurry rate as shown in the cumulative probability distribution 620 of FIG. 6) when a ball-seat event can occur can also be determined. Thus, the third step in the algorithm is to compare a real-time slope of slurry rate to the historical slopes of slurry rates to determine if the real-time slope of slurry rate occurs at the historical most likely slope of the slurry rate for a ball-seat event and/or also determine if the slope of slurry rate is within the historical bounds (i.e., minimum and maximum) at which the ball-seat event occurs.

Figure 7:
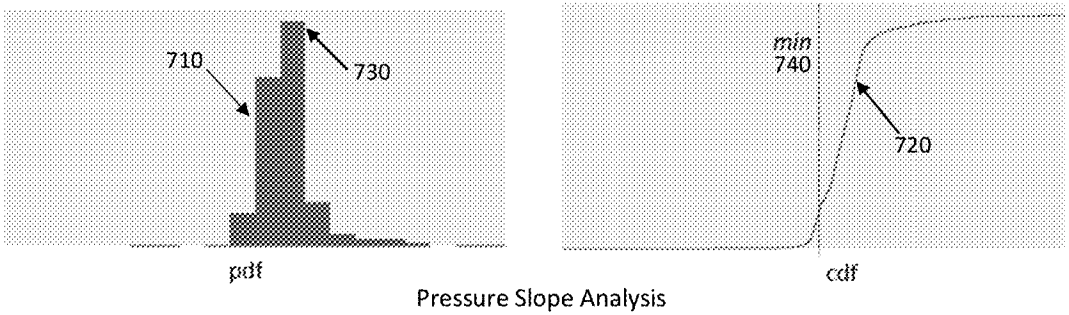
FIG. 7 illustrates an example of a pressure slope analysis.

If it is determined that the real-time slope of slurry rate occurs at the historical most likely slope of slurry rate (and if the real-time slope of slurry rate is within the historical bounds at which a ball-seat event occurs), the algorithm proceeds to a next step where rate of change fluid pressure of the fracturing fluid is analyzed by the algorithm, i.e., a pressure slope analysis. FIG. 7 illustrates graphs 700 of both a probability distribution 710 and a cumulative probability distribution 720 of historical slopes of pressure of fracturing fluid pumped into a wellbore when a ball is released into the wellbore. In FIG. 7, the x-axis in both the probability 710 and cumulative probability 720 distributions represents, e.g., a slope of pressure of fracturing fluid as disclosed above. From the historical data, a ball-seat event is, in general, associated with an increase in the pressure slope. Thus, a magnitude of the fracturing fluid pressure change can be utilized to detect a ball-seat event. Typically, the pressure slope changes when the ball-seat event occurs and the slope will change in a positive direction. This slope change usually occurs after the ball-seat event occurs. Hence, the detection of the ball-seat event actually occurs a short time, e.g., a few seconds, after the actual ball-seat event.

An analysis of historical pressure slopes until a ball seats is shown in FIG. 7. From the historical pressure slopes (both the probability distribution 710 and the cumulative probability distribution 720), a most likely pressure slope 730 at which a ball-seat occurs can be determined, e.g., as noted in the probability distribution 710 of FIG. 7. Further, a bound of the pressure slope above which a ball-seat event occurs can also be determined from this historical data (noted as the minimum line 740 in the cumulative probability distribution 720 of FIG. 7). Thus, the next step in the algorithm is to compare a real-time pressure slope to this historical data to determine if the real-time pressure slope occurs at the historical most likely pressure slope for a ball-seat event and/or also determine if the pressure slope is above the historical bound at which a ball-seat event occurs.

The algorithm also considers when a real-time volume ratio exceeds a maximum amount, e.g., the maximum line shown in the cumulative probability distribution of FIG. 4. Further, the algorithm also considers when real-time slurry rate is above a maximum amount, e.g., the maximum line shown in the cumulative probability distribution of FIG. 5. If the real-time volume ratio exceeds the maximum amount or if the real-time slurry rate exceeds the maximum amount, the algorithm determines the ball-seat event by tracing the pressure of the fracturing fluid back until a first onset of pressure rather than from the other steps of the algorithm disclosed above.

Figure 8A:
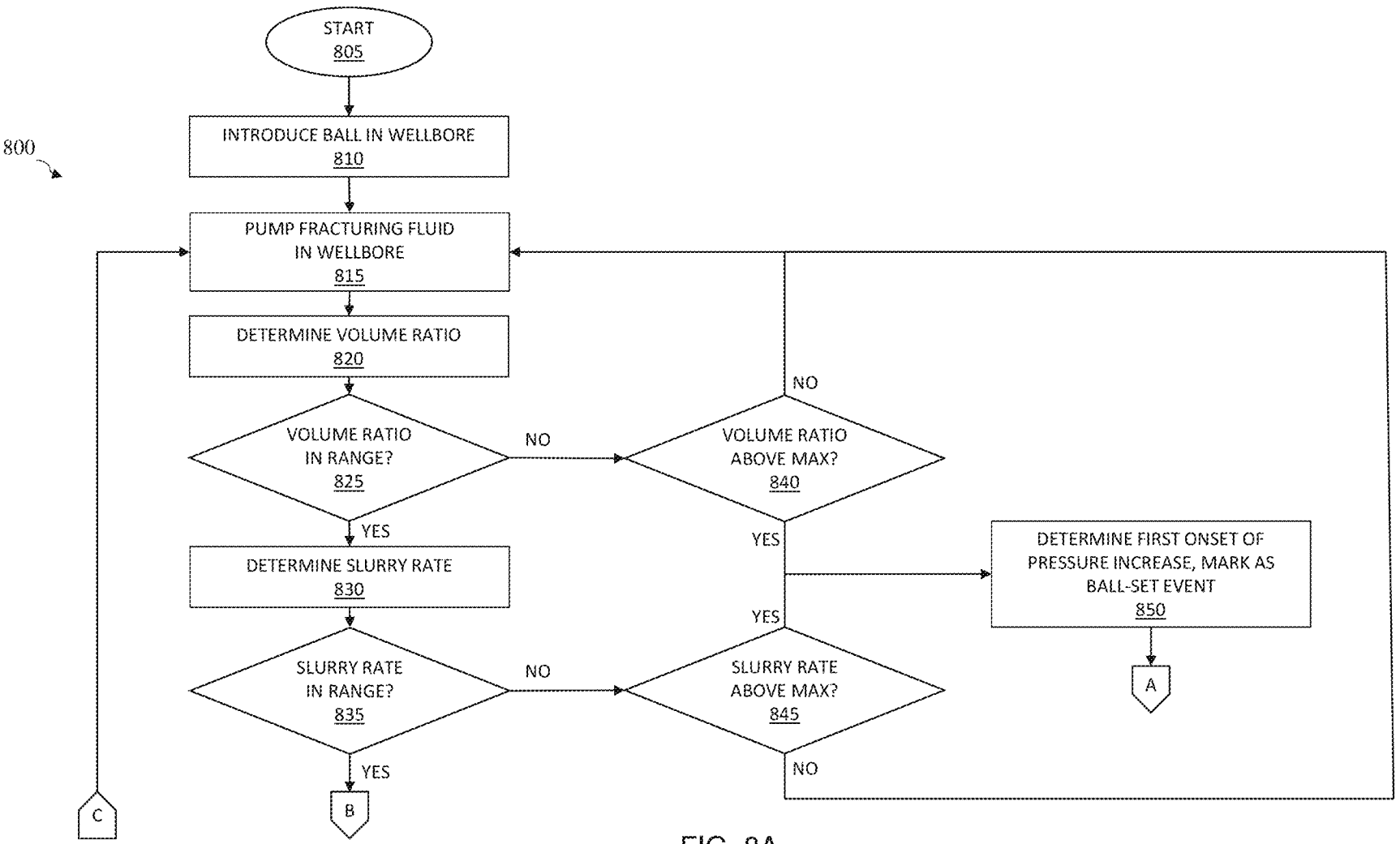
FIGS. 8A-8B illustrate a flow diagram of an example for ball-seat detection according to principles of the disclosure.
Figure 8B:
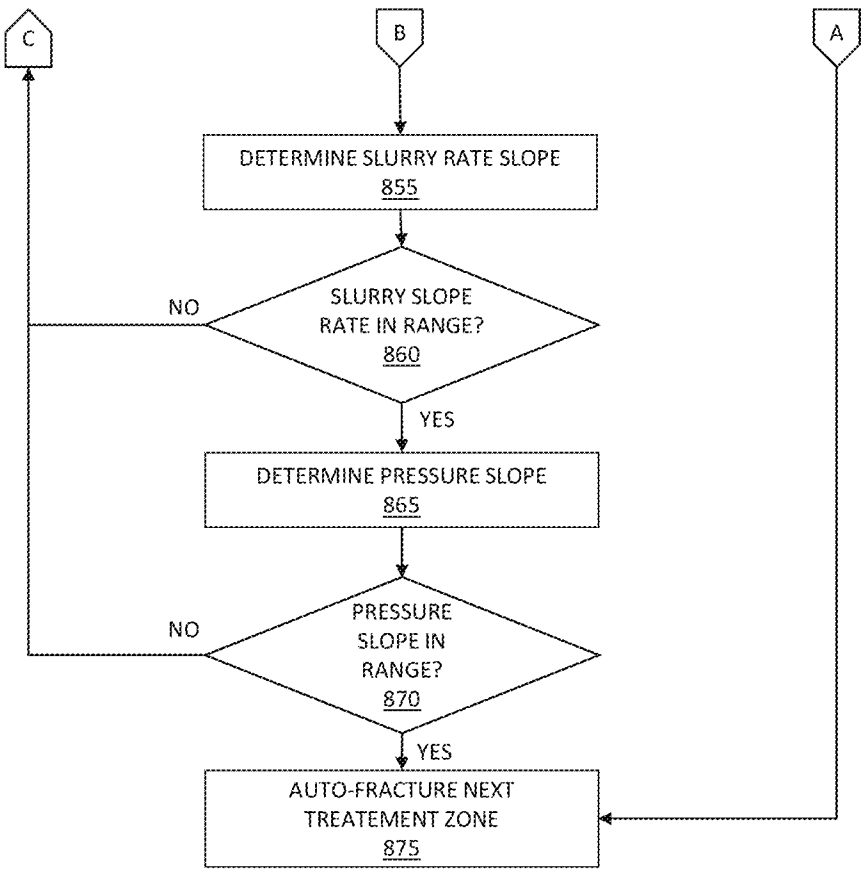

FIGS. 8A-8B illustrate a flow diagram of an example of method 800 of automatic ball-seat detection carried out according to principles of the disclosure. At least a portion of method 800 can be performed by a computing system for detecting ball-seat events, such as disclosed in FIG. 9. At least a portion of method 800 can be performed by a series of operating instructions that correspond to one or more of the algorithms disclosed herein for determining a ball-seat event. Method 800 starts at step 805. At step 810, at least one fracturing ball is introduced into a wellbore and at step 815 fracturing fluid is pumped along with the ball into the wellbore. Pump trucks 116 of FIG. 1 are an example of equipment used to pump, e.g., fracturing fluid, proppant, and at least one fracturing ball into wellbore 102. At step 820, a real-time volume ratio is determined. As disclosed above, the real-time volume ratio can be, e.g., a ratio of a volume of fracturing fluid pumped with at least one ball until the at least one ball seats in a perforation plug to a volume of the wellbore from a surface to the perforation plug.

At step 825 of method 800, it is determined whether the real-time volume ratio determined in step 820 is within a historical volume ratio range by a technique, e.g., as disclosed above with respect to FIG. 4. If, at step 825, it is determined that the real-time volume ratio is not within the historical volume ratio range, method 800 proceeds to step 840. If, at step 825, it is determined that the real-time volume ratio is within the historical volume ratio range, method 800 proceeds to step 830. At step 830, a real-time slurry rate is determined. At step 835, it is determined whether the slurry rate determined in step 830 is within a historical slurry rate range by a technique, e.g., as disclosed above with respect to FIG. 5. If, at step 835, it is determined that the real-time slurry rate is not within the historical slurry rate range, method 800 proceeds to step 845. If, at step 835, it is determined that the real-time slurry rate is within the historical slurry rate range, method 800 proceeds to step 855.

At step 840, it is determined whether the real-time volume ratio is above a historical maximum value by a technique, e.g., as disclosed above. If, at step 840, the real-time volume ratio is determined to not above the historical maximum value, method 800 proceeds back to step 815 where fracturing fluid and the at least one ball is pumped into the wellbore. If, at step 840, the real-time volume ratio is determined to be above the historical maximum value, method 800 proceeds to step 850.

At step 845, it is determined whether the real-time slurry rate is above a historical maximum value by a technique, e.g., as disclosed above. If, at step 845, the real-time slurry rate is determined to not be above the historical maximum value, method 800 proceeds to back to step 815 where fracturing fluid and the at least one ball is pumped into the wellbore. If, at step 845, the real-time slurry rate is determined to be above the historical maximum value, method 800 proceeds to step 850. At step 850, a first onset of pressure increase of the fracturing fluid is determined and a ball-set event is marked at that point. Method 800 then proceeds to step 875.

At step 855 a real-time slurry rate slope is determined. At step 860, it is determined whether the real-time slurry slope rate determined in step 855 is within a historical range by a technique, e.g., as disclosed above with respect to FIG. 6. If, at step 860, the real-time slurry rate slope is determined to not be within the historical range, method 800 proceeds back to step 815 where fracturing fluid and the at least one ball is pumped into the wellbore. If, at step 860, the real-time slurry rate slope is determined to be within the historical range, method 800 proceeds to step 865.

At step 865, a real-time pressure slope is determined. At step 870, it is determined whether the pressure slope determined in step 865 is within a historical range by a technique, e.g., as disclosed above with respect to FIG. 7. If, at step 870 the real-time pressure slope is determined to not be within the historical range, method 800 proceeds back to step 815 where fracturing fluid and the at least one ball is pumped into the wellbore. If, at step 870, the real-time pressure slope is determined to be within the historical range, method 800 proceeds to step 875.

At step 875, a pressure of fracturing fluid introduced into the wellbore can be increased to perform a fracturing treatment on the next fracture treatment zone. Step 875 occurs automatically without any human interpretation of any data or any human interaction of any kind.

Figure 9:
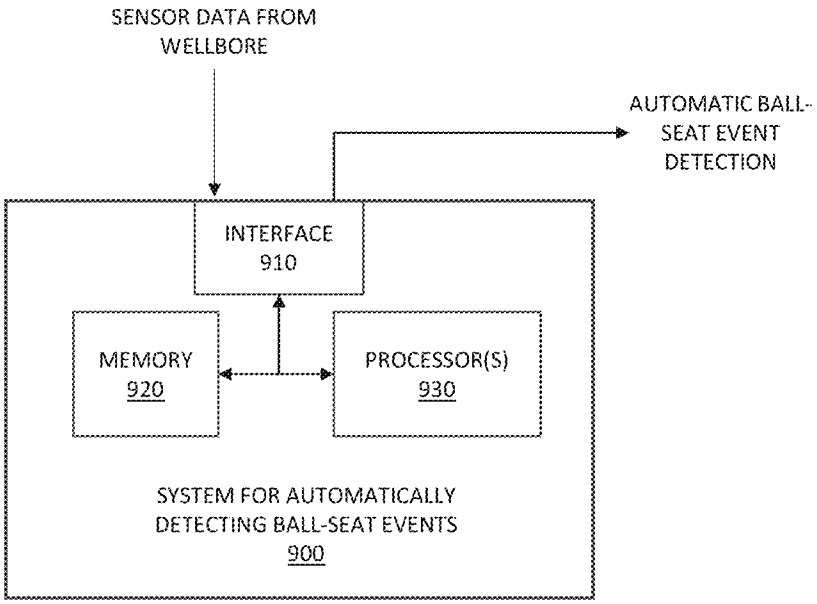
FIG. 9 illustrates a block diagram of an example computing system for use according to principles of the disclosure.

Computing system 900, illustrated in FIG. 9, provides an example of injection treatment control subsystem 111 or computing subsystem 110 that can perform the automatic fracturing operations disclosed above. Computing system 900 can be located proximate a well site, or a distance from the well site, such as in a data center, cloud environment, corporate location, a lab environment, or another location. Computing system 900 can be a distributed system having a portion located proximate a well site and a portion located remotely from the well site. Computing system 900 includes a communications interface 910, a memory (or data storage) 920, and one or more processors 930.

Communication interface 910 is configured to transmit and receive data. For example, communication interface 910 can receive real-time observations of pressure and/or flow of fracturing fluid from pressure and/or flow sensors in, e.g., pump trucks 116 at surface 106 during a stimulation operation, e.g., a hydraulic fracturing operation. As disclosed above, these real-time observations of pressure and/or flow of fracturing fluid are not made from complex and expensive sensors downhole. Once computing system 900 determines an automatic ball-seat event, e.g., as disclosed above, computing system 900 communicates the ball-seat event, e.g., through communication interface 910, to, e.g., pump trucks 116 where pump trucks 116 can automatically initiate a fracturing treatment on a next fracture treatment zone.

Memory 920 can be configured to store a series of operating instructions that direct the operation of the one or more processors 930 when initiated thereby, including code representing the algorithm for determining a ball-seat event illustrated in FIGS. 3-8B. Code for employing sensor data from received real-time observations of pressure and/or flow of fracturing fluid from pressure and/or flow sensors in, e.g., pump trucks 116 at surface 106 during a stimulation operation can also be stored in memory 920. Memory 920 is a non-transitory computer readable medium. Memory 920 can be a distributed memory.

The one or more processors 930 are configured to detect, e.g., a ball-seat event. Further, the one or more processors 930 are configured to control the hydraulic fracturing operation by, e.g., causing adjustments to a pumping schedule based on the detected ball-seat event. The one or more processors 930 can also be configured for real time monitoring, e.g., of the received real-time observations of pressure and/or flow of fracturing fluid from the pressure and/or flow sensors in, e.g., pump trucks 116. The one or more processors 930 include the logic to communicate with communications interface 910 and memory 920, and perform the functions described herein using sensor data, such as real time sensor data, from sensors associated with the wellbore.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magnetooptical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

What is claimed is:

1. A method of controlling automated fracturing operations in a wellbore, the method comprising:

automatically detecting a ball-seat event, wherein the automatically detecting includes:

determining a volume ratio is in a predetermined range and within a minimum and maximum bound, wherein the volume ratio is a ratio of a volume of a fracturing fluid pumped into the wellbore from a time a ball is introduced into the wellbore to a predetermined volume of the wellbore;

then determining a slurry rate is in a predetermined range and is within a minimum and maximum bound;

then determining a slope of a slurry rate is in a predetermined range and within a minimum and maximum bound; and then determining a slope of a pressure change of the fracturing fluid in the wellbore is in a predetermined range and within a minimum and maximum bound; and automatically fracturing a formation at a next treatment zone once the ball-seat event has been automatically detected.

2. The method of claim 1, wherein at least one of:

the predetermined volume ratio range and minimum and maximum bounds are determined from historical data;

the predetermined slurry rate range and minimum and maximum bounds are determined from historical data;

the predetermined slope of the slurry rate range and minimum and maximum bounds are determined from historical data; and the predetermined slope of the pressure change of the fracturing fluid range and minimum and maximum bounds are determined from historical data.

3. The method of claim 2, wherein the minimum and maximum bounds of at least one of the volume ratio, slurry rate, slope of the slurry rate change, or slope of the pressure change of the fracturing fluid are based on probability distribution and cumulative probability distribution functions.

4. The method of claim 1, wherein the predetermined volume of the wellbore is a volume of the wellbore from a surface of the wellbore to a current treatment zone.

5. The method of claim 1, wherein the volume of fracturing fluid, the slurry rate, and a pressure of the fracturing fluid are measured at a surface of the wellbore.

6. The method of claim 1, wherein the slope of the slurry rate and the slope of the pressure change of the fracturing fluid are determined at a surface of the wellbore.

7. The method of claim 1, further comprising determining the automatic ball-seat event is based on a first onset of pressure increase of the fracturing fluid when the volume ratio is above its maximum bound or the slurry rate is above its maximum bound.

8. A computer program product having a series of operating instructions stored on a non-transitory computer-readable medium that cause at least one processor to perform operations, the operations comprising:

automatically detecting a ball-seat event, wherein the automatically detecting includes:

determining a volume ratio is in a predetermined range and within a minimum and maximum bound, wherein the volume ratio is a ratio of a volume of a fracturing fluid pumped into a wellbore from a time a ball is introduced into the wellbore to a predetermined volume of the wellbore;

then determining a slurry rate is in a predetermined range and is within a minimum and maximum bound;

then determining a slope of a slurry rate is in a predetermined range and within a minimum and maximum bound; and then determining a slope of a pressure change of the fracturing fluid in the wellbore is in a predetermined range and within a minimum and maximum bound; and automatically fracturing a formation at a next treatment zone once the ball-seat event has been automatically detected.

9. The method of claim 8, wherein at least one of:

the predetermined volume ratio range and minimum and maximum bounds are determined from historical data;

the predetermined slurry rate range and minimum and maximum bounds are determined from historical data;

the predetermined slope of the slurry rate range and minimum and maximum bounds are determined from historical data; and the predetermined slope of the pressure change of the fracturing fluid range and minimum and maximum bounds are determined from historical data.

10. The computer program product of claim 9, wherein the minimum and maximum bounds of at least one of the volume ratio, slurry rate, slope of the slurry rate change, or slope of the pressure change of the fracturing fluid are based on probability distribution and cumulative probability distribution functions.

11. The computer program product of claim 8, wherein the predetermined volume of the wellbore is a volume of the wellbore from a surface of the wellbore to a current treatment zone.

12. The computer program product of claim 8, wherein the volume of fracturing fluid, the slurry rate, and a pressure of the fracturing fluid are measured at a surface of the wellbore.

13. The computer program product of claim 8, wherein the slope of the slurry rate and the slope of the pressure change of the fracturing fluid are determined at a surface of the wellbore.

14. The computer program product of claim 8, further comprising determining the automatic ball-seat event is based on a first onset of pressure increase of the fracturing fluid when the volume ratio is above its maximum bound or the slurry rate is above its maximum bound.

15. A computing system to control automated fracturing operations in a wellbore, the computing system comprising:

one or more processors to perform one or more operations including:

automatically detecting a ball-seat event, wherein the automatically detecting includes:

determining a volume ratio is in a predetermined range and within a minimum and maximum bound, wherein the volume ratio is a ratio of a volume of a fracturing fluid pumped into the wellbore from a time a ball is introduced into the wellbore to a predetermined volume of the wellbore;

then determining a slurry rate is in a predetermined range and is within a minimum and maximum bound;

then determining a slope of a slurry rate is in a predetermined range and within a minimum and maximum bound; and then determining a slope of a pressure change of the fracturing fluid in the wellbore is in a predetermined range and within a minimum and maximum bound; and automatically fracturing a formation at a next treatment zone once the ball-seat event has been automatically detected.

16. The computing system of claim 15, wherein at least one of:

the predetermined volume ratio range and minimum and maximum bounds are determined from historical data;

the predetermined slurry rate range and minimum and maximum bounds are determined from historical data;

the predetermined slope of the slurry rate range and minimum and maximum bounds are determined from historical data; and the predetermined slope of the pressure change of the fracturing fluid range and minimum and maximum bounds are determined from historical data.

17. The computing system of claim 16, wherein the minimum and maximum bounds of at least one of the volume ratio, slurry rate, slope of the slurry rate change, or slope of the pressure change of the fracturing fluid are based on probability distribution and cumulative probability distribution functions.

18. The computing system of claim 15, wherein the predetermined volume of the wellbore is a volume of the wellbore from a surface of the wellbore to a current treatment zone.

19. The computing system of claim 15, further comprising sensors at a surface of the wellbore configured to measure the volume of fracturing fluid, the slurry rate, and a pressure of the fracturing fluid.

20. The computing system of claim 15, wherein the slope of the slurry rate and the slope of the pressure change of the fracturing fluid are determined at a surface of the wellbore.

* * * * *